US011282419B2

(12) United States Patent
Huang

(10) Patent No.: US 11,282,419 B2
(45) Date of Patent: Mar. 22, 2022

(54) DETECTION METHOD, DISPLAY PANEL, AND DRIVE METHOD

(71) Applicant: HKC CORPORATION LIMITED, Shenzhen (CN)

(72) Inventor: Bei Zhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 438 days.

(21) Appl. No.: 16/340,139

(22) PCT Filed: Oct. 22, 2018

(86) PCT No.: PCT/CN2018/111239

§ 371 (c)(1),
(2) Date: Apr. 8, 2019

(87) PCT Pub. No.: WO2020/051981

PCT Pub. Date: Mar. 19, 2020

(65) Prior Publication Data

US 2021/0343202 A1 Nov. 4, 2021

(30) Foreign Application Priority Data

Sep. 12, 2018 (CN) ..... 201811059264.9

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 2320/0233* (2013.01); *G09G 2320/043* (2013.01)

(58) Field of Classification Search
CPC ..... G09G 3/006; G09G 2320/043; G09G 2320/0223; G09G 2320/0233; G09G 3/3677; G09G 2300/0426; G02F 1/136286
USPC ..... 345/204
See application file for complete search history.

(56) References Cited

U.S. PATENT DOCUMENTS

2002/0167474 A1* 11/2002 Everitt ..... G09G 3/3216 345/82
2003/0117356 A1* 6/2003 Moon ..... G02F 1/13452 345/87
2016/0335972 A1* 11/2016 Lee ..... G09G 3/3677
2017/0162105 A1* 6/2017 Kim ..... H01L 27/124
2018/0129106 A1* 5/2018 Gao ..... G09G 3/3611

FOREIGN PATENT DOCUMENTS

CN 101154367 A 4/2008
CN 201716962 U 1/2011
CN 103198803 A 7/2013
(Continued)

OTHER PUBLICATIONS

Xiaolan Li, the ISA written comments, Jun. 2019, CN.

*Primary Examiner* — Kent W Chang
*Assistant Examiner* — Sujit Shah

(57) ABSTRACT

A detection method, a display panel, and a drive method are disclosed. The detection method includes: performing group compensation on a scanning line by externally connecting to a compensation resistor having an adjustable resistance value and writing a corresponding resistance compensation value into a gate drive resistance compensation table.

19 Claims, 4 Drawing Sheets

(56) References Cited

FOREIGN PATENT DOCUMENTS

| | | | |
|---|---|---|---|
| CN | 104424907 | A | 3/2015 |
| CN | 104835473 | A | 8/2015 |
| JP | 2008058634 | A | 3/2008 |
| JP | 2009008942 | A | 1/2009 |

* cited by examiner

DETECTION METHOD, DISPLAY PANEL, AND DRIVE METHOD

This application claims priority to Chinese Patent Application No. CN201811059264.9, filed with the Chinese Patent Office on Sep. 12, 2018 and entitled "DETECTION METHOD, DISPLAY PANEL, AND DRIVE METHOD", which is incorporated herein by reference in its entirety.

TECHNICAL FIELD

This application relates to the field of display technologies, and in particular, to a detection method, a display panel, and a drive method.

BACKGROUND

Statement herein merely provides background information related to this application and does not necessarily constitute the prior art.

With the development and progress of technologies, a liquid crystal display has hot spots such as a thin body, a power saving feature, and low radiation, and therefore becomes a mainstream product of displays and is widely applied. Most of liquid crystal displays on the market are backlight-type liquid crystal displays, including liquid crystal panels and backlight modules. A working principle of a liquid crystal panel is placing liquid crystal molecules between two parallel glass substrates and applying a drive voltage to the two glass substrates to control rotation directions of the liquid crystal molecules, to refract light of the backlight module to generate a picture.

A thin film transistor-liquid crystal display (TFT-LCD) has performance such as low power consumption, good picture quality, and a relatively high production yield and therefore has currently gradually been dominant in the field of display. In addition, the thin film transistor-liquid crystal display includes a liquid crystal panel and a backlight module. The liquid crystal panel includes a color filter substrate (CF substrate), a thin film transistor array substrate (TFT substrate), and a mask, and transparent electrodes are provided on relative inner sides of the substrates. A layer of liquid crystal (LC) molecules is sandwiched between two substrates. Display of a display picture of a display panel is nonuniform.

SUMMARY

This application aims to provide a detection method, a display panel, and a drive method that can make picture display of a display panel present a uniform and stable state and improve a display effect of the display panel.

To achieve the foregoing objective, this application provides a detection method, in particular, a detection method for performing resistance compensation on a scanning line of a display panel, comprising:

obtaining a gate drive signal of a scanning line in a current group of scanning lines from a multiplicity of groups of scanning lines;

externally connecting to a compensation resistor having an adjustable resistance value and adjusting the resistance value of the compensation resistor;

storing the resistance value of the current compensation resistor as a resistance compensation value of the current group of scanning lines when the gate drive signal after adjustment satisfies a preset target gate drive signal condition;

writing the location of the current group of scanning lines and the corresponding resistance compensation value into a gate drive resistance compensation table; and completing resistance compensation detection of all groups of scanning lines of a current display panel.

Optionally, the step of obtaining a gate drive signal of a scanning line in a current group of scanning lines from a multiplicity of groups of scanning lines comprises:

detecting a high level voltage value of the obtained gate drive signal; and the step of storing the resistance value of the current compensation resistor as a resistance compensation value of the current group of scanning lines when the gate drive signal after adjustment satisfies a preset target gate drive signal condition comprises:

considering that the gate drive signal after adjustment satisfies the preset target gate drive signal condition when the high level voltage value of the gate drive signal after adjustment reaches a preset high level voltage threshold.

Optionally, the preset high level voltage threshold is greater than or equal to a high level voltage value of a gate drive signal of a scanning line farthest from a drive circuit board of the display panel.

Optionally, detection starts from a scanning line farthest from a drive circuit board of the display panel.

Optionally, detection starts by using a gate drive signal of a scanning line farthest from a drive circuit board of the display panel as a target gate drive signal condition.

Optionally, the display panel comprises a multiplicity of gate driver chips, and the multiplicity of groups of scanning lines uses scanning lines output by a gate driver chip as a group.

Optionally, a multiplicity of close gate driver chips is used as a group.

Optionally, one of the scanning lines is used as a group, and each scanning line is respectively compensated.

This application further discloses a drive method, in particular, a drive method for performing resistance compensation on a scanning line of a display panel, comprising:

looking up, according to the location of a current data line, a preset gate drive resistance compensation table adapted to a corresponding resistance compensation value to compensate an output signal.

This application further discloses a display panel. A multiplicity of scanning lines is provided on the display panel. The display panel further comprises:

a drive circuit board, a scanning drive circuit, and a resistance compensation circuit, wherein the resistance compensation circuit is arranged between an output end of the scanning drive circuit and a corresponding scanning line; and the resistance compensation circuit comprises:

a memory, storing a gate drive resistance compensation table; and a resistance value selection circuit, reading a resistance compensation value corresponding to the location of the current scanning line from the memory and performing resistance compensation on the output end of the current scanning drive circuit according to the resistance compensation value.

Optionally, the scanning drive circuit or the corresponding resistance compensation circuit may be directly arranged on the drive circuit board and be connected to the display panel, may be arranged in the gate driver chip and be connected to the display panel by using a chip on film (COF), may be a gate driver on array (GOA) and be directly formed on the display panel, or may be a chip on glass (COG).

Optionally, the scanning drive circuit comprises a multiplicity of gate driver chips, and the resistance compensation circuit is arranged in at least one of the gate driver chips.

Optionally, the scanning drive circuit comprises a multiplicity of gate driver chips, the same resistance compensation circuit is provided in all the gate driver chips, the scanning drive circuit further comprises a location signal cable, connected to the drive circuit board and transmitting corresponding location information of the current scanning line on the display panel, the corresponding location information of the scanning line on the display panel corresponds to a resistance compensation value recorded in the gate drive resistance compensation table, and the resistance value selection circuit performs resistance compensation on the output end of the current scanning drive circuit according to the resistance compensation value.

Optionally, the location signal cable transmits a corresponding location value (ID) of the current scanning line on the display panel.

Optionally, the resistance value selection circuit comprises a selector switch and a digital resistor, and the selector switch selects to open a corresponding digital resistor according to the corresponding location value (ID) of the current scanning line on the display panel, so that the corresponding scanning line is connected in series to the digital resistor having a corresponding resistance value for resistance compensation.

Optionally, the foregoing method is applied to resistance values of resistors connected in series, resistance values of resistors connected in parallel, and resistance values of resistors connected in series and in parallel provided that the high level voltage value of the output gate drive signal reaches a preset high level voltage value and has a function of changing potential of the output scanning line.

The scanning lines in the display panel have different resistors, and consequently, threshold signals of the scanning lines are different in delay. In this application, the gate drive signal of the scanning line is adjusted by externally connecting to the compensation resistor, so that the gate drive signal of the scanning line satisfies a target gate drive signal condition; the resistance value of the externally connected compensation resistor is written into the gate drive resistance compensation table; when an impedance difference between the scanning lines is compensated, delay of resistors of all the scanning lines is compensated by looking up the gate drive resistance compensation table, so that the output gate drive signal has better consistency, to improve a situation in which display effects of horizontal display areas of the display panel are different, so that picture display of the display panel presents a uniform and stable state, thereby improving a display effect of the display panel. By setting the gate drive resistance compensation table in the display panel, the resistance compensation value of the corresponding scanning line may be set or changed according to needs. Once a problem occurs in an inspection process, the display panel may be recovered only by changing the gate drive resistance compensation table without changing hardware, improving a yield of the display panel.

BRIEF DESCRIPTION OF DRAWINGS

The included accompanying drawings are used to provide further understanding of the embodiments of this application, constitute a part of the specification, and are used to illustrate implementations of this application and explain the principle of this application together with literal descriptions. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION

Figure 1:
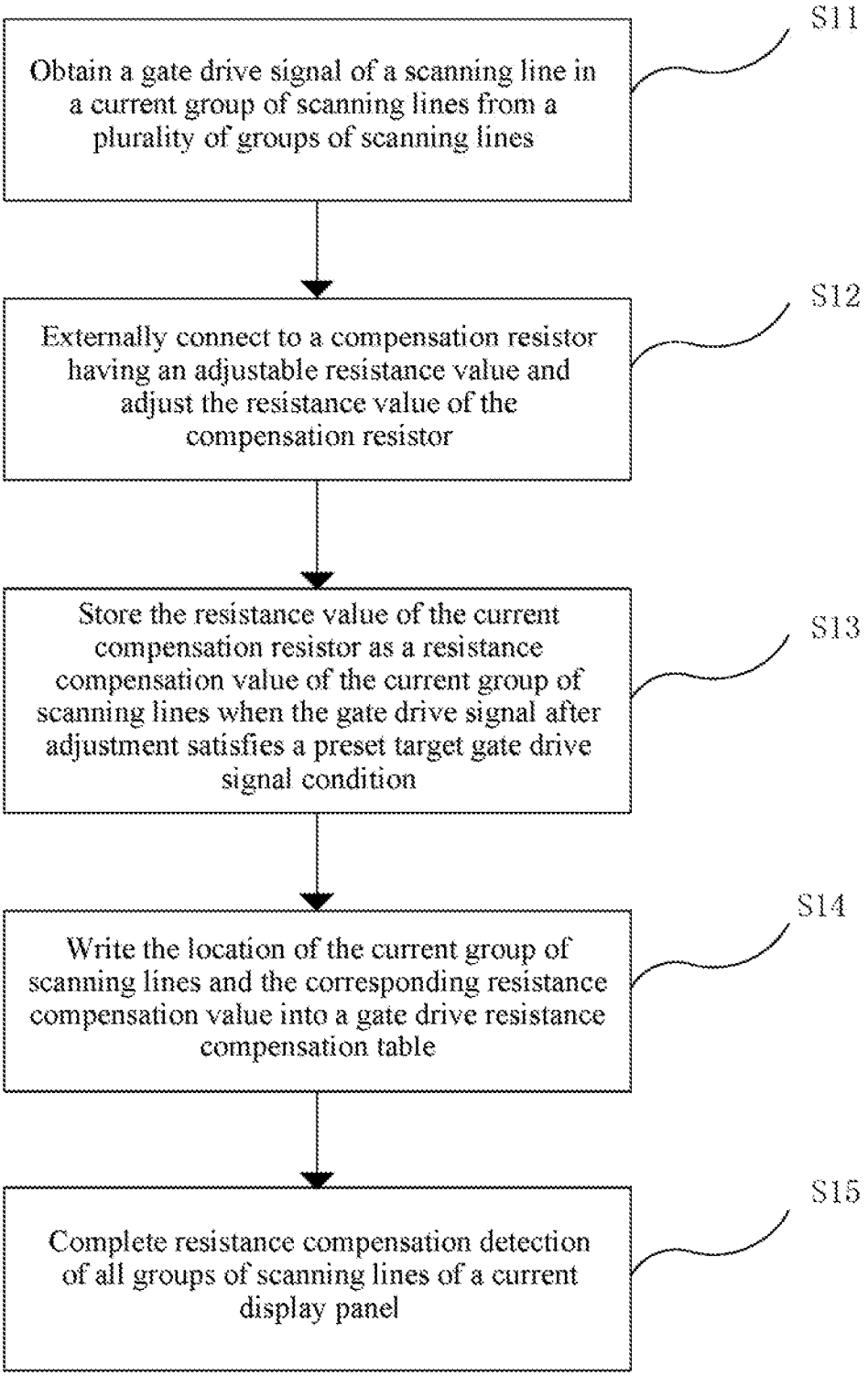
FIG. 1 is an application flowchart of a detection method according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Hence, features defined by "first" or "second" may explicitly indicate or implicitly include one or more of the features. In the description of this application, unless otherwise stated, "a multiplicity of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

This application is further described below with reference to the accompanying drawings and embodiments.

Referring to FIG. 1, an embodiment of this application discloses a detection method, in particular, a detection method for performing resistance compensation on a scanning line of a display panel, including:

S11: Obtain a gate drive signal of a scanning line in a current group of scanning lines from a multiplicity of groups of scanning lines.

S12: Externally connect to a compensation resistor having an adjustable resistance value and adjust the resistance value of the compensation resistor.

S13: Store the resistance value of the current compensation resistor as a resistance compensation value of the current group of scanning lines when the gate drive signal after adjustment satisfies a preset target gate drive signal condition.

S14: Write the location of the current group of scanning lines and the corresponding resistance compensation value into a gate drive resistance compensation table.

S15: Complete resistance compensation detection of all groups of scanning lines of a current display panel.

The scanning lines in the display panel have different resistors, and consequently, threshold signals of the scanning lines are different in delay. In this solution, the gate drive signal of the scanning line is adjusted by externally connecting to the compensation resistor, so that the gate drive signal of the scanning line satisfies the target gate drive signal condition; the resistance value of the externally connected compensation resistor is written into the gate drive resistance compensation table; when an impedance difference between the scanning lines is compensated, delay of resistors of all the scanning lines is compensated by looking up the gate drive resistance compensation table, so that the output gate drive signal has better consistency, to improve a situation in which display effects of horizontal display areas of the display panel are different, so that picture display of the display panel presents a uniform and stable state, thereby improving a display effect of the display panel. By setting the gate drive resistance compensation table in the display panel, the resistance compensation value of the corresponding scanning line may be set or changed according to needs. Once a problem occurs in an inspection process, the display panel may be recovered only by changing the gate drive resistance compensation table without changing hardware, improving a yield of the display panel.

In this embodiment, optionally, step S11 of obtaining a gate drive signal of a scanning line in a current group of scanning lines from a multiplicity of groups of scanning lines includes:

detecting a high level voltage value of the obtained gate drive signal; and the step S13 of storing the resistance value of the current compensation resistor as a resistance compensation value of the current group of scanning lines when the gate drive signal after adjustment satisfies a preset target gate drive signal condition includes:

considering that the gate drive signal after adjustment satisfies the preset target gate drive signal condition when the high level voltage value of the gate drive signal after adjustment reaches a preset high level voltage threshold.

In this solution, in the method of making the high level voltage value of the gate drive signal reach the preset high level voltage threshold by adjusting the resistance value of the compensation resistor, whether the high level voltage value of the gate drive signal reaches the preset high level voltage threshold may be intuitively observed. If the high level voltage value of the gate drive signal does not reach the preset high level voltage threshold, the resistance value of the compensation resistor continues to be adjusted, so that an adjustment process is intuitive and accurate, to obtain gate drive signals having consistent high level voltage values by adjusting high level voltage values of gate drive signals of all scanning lines and improve a situation in which display effects of horizontal display areas of the display panel are different, so that picture display of the display panel presents a uniform and stable state, thereby improving a display effect of the display panel.

In this embodiment, optionally, the preset high level voltage threshold is greater than or equal to a high level voltage value of a gate drive signal of a scanning line farthest from a drive circuit board of the display panel.

In this solution, if the preset high level voltage threshold is equal to the high level voltage value of the gate drive signal of the scanning line farthest from the drive circuit board, other scanning lines all use the high level voltage value of the gate drive signal of the scanning line farthest from the drive circuit board as a condition of satisfying a preset target gate drive signal. When resistance compensation detection is performed on the scanning line, detection and resistance compensation may not need to be performed on the scanning line farthest from the drive circuit board, reducing the number of times of resistance compensation detection and accelerating a production process. If the preset high level voltage threshold is greater than the high level voltage value of the gate drive signal of the scanning line farthest from the drive circuit board, when batch debugging is performed, a high level voltage value of a gate drive signal of a scanning line, farthest from a drive circuit board, of each display panel does not need to be detected in advance, and a threshold of a high level voltage may be adjusted according to needs, to adjust resistance values of compensation resistors needed by all scanning lines in the display panel, and obtain needed gate drive signals of scanning lines of the display panel when the gate drive signals of the scanning lines are consistent.

In this embodiment, optionally, detection starts from the scanning line farthest from the drive circuit board of the display panel.

In this solution, the scanning line farthest from the drive circuit board of the display panel has a largest resistance, and detection starts from the scanning line. After a smallest resistance value on which resistance compensation needs to be performed is determined, a scanning line having a greater resistance value on which resistance compensation needs to be performed may be gradually detected. In addition, in a detection process, resistance values for resistance compensation intend to increase, so that an intuitive and clear change curve is obtained in a process of collecting statistics on resistance values for resistance compensation of scanning lines and so that data in the formed gate drive resistance compensation table presents a state of sequentially changing, to facilitate search in the gate drive resistance compensation table in an actual drive process when the compensation resistor performs resistance compensation on the scanning lines.

In this embodiment, optionally, detection starts by using the gate drive signal of the scanning line farthest from the drive circuit board of the display panel as the target gate drive signal condition.

In this solution, the scanning line farthest from the drive circuit board of the display panel has a largest resistance, and detection starts from the scanning line. After a smallest resistance value on which resistance compensation needs to be performed is determined, a scanning line having a greater resistance value on which resistance compensation needs to be performed may be gradually detected. In addition, in a detection process, resistance values for resistance compensation intend to increase, so that an intuitive and clear change curve is obtained in a process of collecting statistics on resistance values for resistance compensation of scanning lines and so that data in the formed gate drive resistance compensation table presents a state of sequentially changing, to facilitate search in the gate drive resistance compensation table in an actual drive process when the compensation resistor performs resistance compensation on the scanning lines.

In this embodiment, optionally, a multiplicity of close gate driver chips is used as a group.

In this solution, close gate driver chips are used as a group, all scanning lines in the group are compensated with a resistance value of the same compensation resistor, to facilitate setting of a metallic wire connected to the gate driver chip, intensively perform resistance compensation on scanning lines output by close gate driver chips, reduce the number of set compensation resistors when the scanning lines reach a target gate drive signal, and accelerate a progress of performing resistance compensation detection on the scanning lines of the display panel.

In this embodiment, optionally, one of the scanning lines is used as a group, and each scanning line is respectively compensated.

In this solution, each scanning line is respectively compensated, each scanning line is compensated with a different resistance value of a compensation resistor, so that compensation is more accurate. Resistance values of all the compensated scanning lines are exactly consistent in height, eliminating a difference between display effects of horizontal display areas of the display panel. Especially, in a circuit using a gate driver on array (GOA), picture presentation of the display panel is more uniform and stable by respectively compensating each scanning line, improving a display effect of the display panel.

In this embodiment, optionally, detection starts by using the gate drive signal of the scanning line farthest from the drive circuit board of the display panel as the target gate drive signal condition.

In this solution, the scanning line farthest from the drive circuit board of the display panel has a largest resistance, and detection starts from the scanning line. After a smallest resistance value on which resistance compensation needs to be performed is determined, a scanning line having a greater resistance value on which resistance compensation needs to be performed may be gradually detected. In addition, in a detection process, resistance values for resistance compensation intend to increase, so that an intuitive and clear change curve is obtained in a process of collecting statistics on resistance values for resistance compensation of scanning lines and so that data in the formed gate drive resistance compensation table presents a state of sequentially changing, to facilitate search in the gate drive resistance compensation table in an actual drive process when the compensation resistor performs resistance compensation on the scanning lines.

In this embodiment, optionally, the display panel includes a multiplicity of gate driver chips, and the multiplicity of groups of scanning lines uses scanning lines output by a gate driver chip as a group.

Because differences between resistances of scanning lines output by a group of gate driver chips are small, the scanning lines may be classified into one group. In this way, only a gate drive signal of a scanning line in one group needs to be detected, to adjust a resistance value of a corresponding compensation resistor, so that a resistance value of a compensation resistor needed by each scanning line in the whole group can be determined, improving working efficiency, reducing the number of times of repeated detection, relieving pressure of resistance compensation from the compensation resistor, and prolonging a service life of the compensation resistor. In addition, the multiplicity of groups of scanning lines uses scanning lines output by a gate driver chip as a group, to save metallic wires connected to the gate driver chip, simplify layout of metallic wires in the display panel, and reduce costs of the display panel.

In another embodiment of this application, a drive method, in particular, a drive method for performing resistance compensation on a scanning line of a display panel, is disclosed. The method includes:

looking up, according to the location of a current data line, a preset gate drive resistance compensation table adapted to a corresponding resistance compensation value to compensate an output signal.

In this solution, the corresponding resistance compensation value is looked up according to the preset gate drive resistance compensation table, ensuring that a resistor compensating the output signal satisfies an overall idea of this application and obtaining a resistance value of a compensation resistor satisfying a target output signal, to improve a problem that display of the display panel is poor and improve a situation in which display effects of horizontal display areas of the display panel are different, so that picture display of the display panel presents a uniform and stable state, thereby improving a display effect of the display panel.

Figure 2:
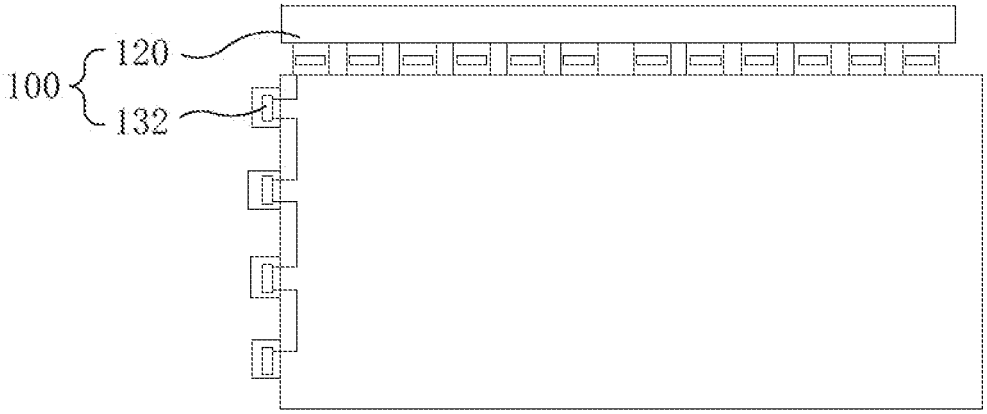
FIG. 2 is a schematic diagram of a display panel according to an embodiment of this application.
Figure 3:
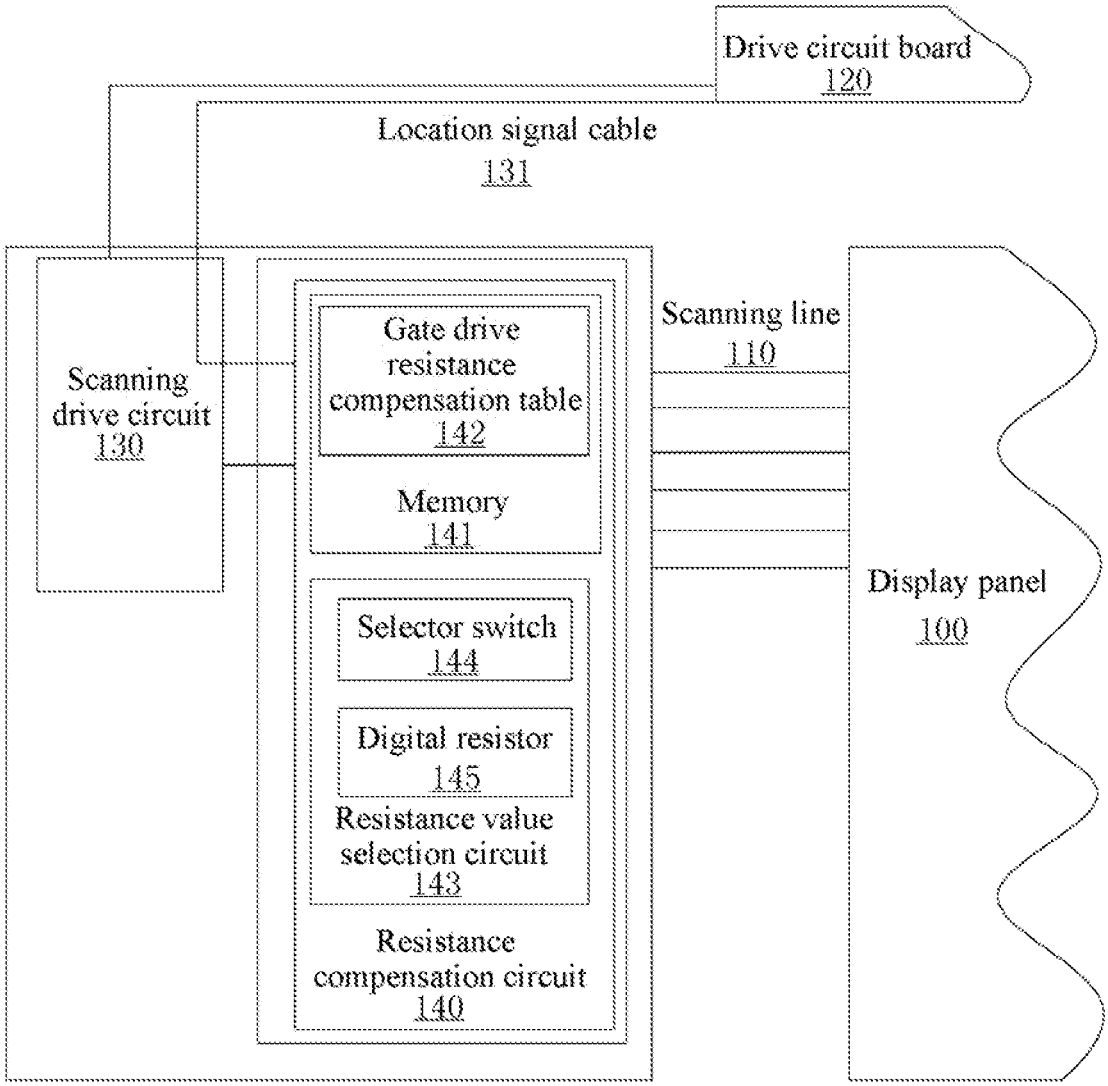
FIG. 3 is a schematic diagram of another display panel according to an embodiment of this application.
Figure 4:
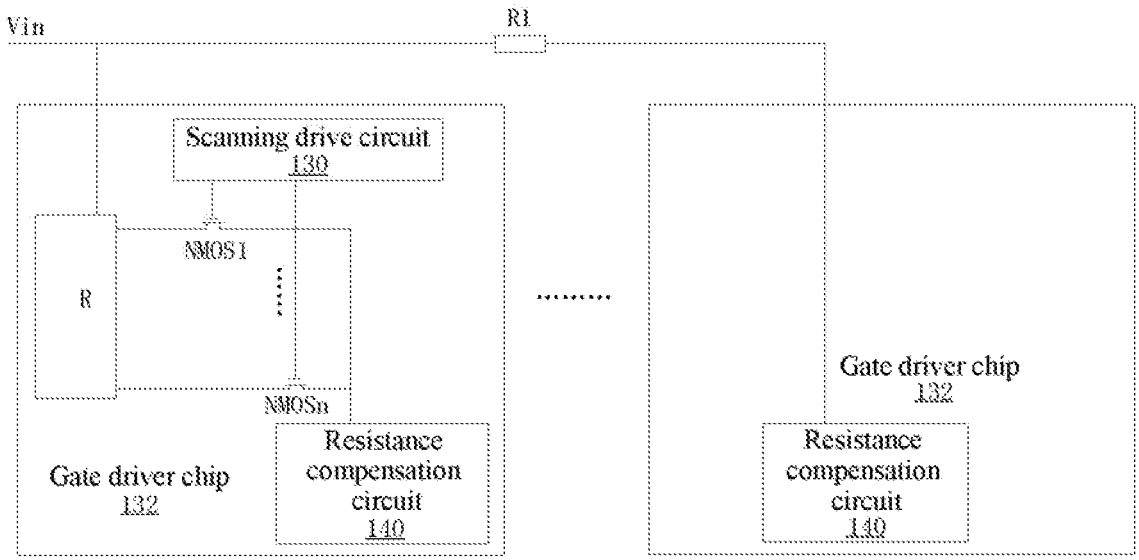
FIG. 4 is a schematic diagram of another display panel according to an embodiment of this application.

In another embodiment of this application, referring to FIG. 2 to FIG. 4, a display panel 100 is disclosed. A multiplicity of scanning lines 110 is provided on the display panel 100. The display panel 100 further includes:

a drive circuit board 120, a scanning drive circuit 130, and a resistance compensation circuit 140, where the resistance compensation circuit 140 is arranged between an output end of the scanning drive circuit 130 and a corresponding scanning line 110; and the resistance compensation circuit 140 includes:

a memory 141, storing a gate drive resistance compensation table 142; and a resistance value selection circuit 143, reading a resistance compensation value corresponding to the location of the current scanning line 110 from the memory 141 and performing resistance compensation on the output end of the current scanning drive circuit 130 according to the resistance compensation value.

In this solution, resistance compensation is performed on the output end of the scanning drive circuit 130 of the scanning line 110 by setting the resistance compensation circuit 140 between the output end of the scanning drive circuit 130 and the corresponding scanning line, so that resistance values of the output end of the scanning drive circuit 130 of the scanning line 110 are consistent. After the resistance compensation value implementing the target drive signal is obtained by looking up the gate drive resistance compensation table 142 stored in the memory 141, the resistance value selection circuit 143 performs resistance compensation on the output end of the scanning drive circuit 130. When an impedance difference between the scanning lines 110 is compensated, the output scanning drive signals have better consistency, to improve a situation in which display effects of horizontal display areas of the display panel 100 are different, so that picture display of the display panel 100 presents a uniform and stable state, thereby improving a display effect of the display panel 100.

Optionally, the scanning drive circuit 130 or the corresponding resistance compensation circuit 140 may be directly arranged on the drive circuit board 120 and be connected to the display panel 100, may be arranged in the gate driver chip 132 and be connected to the display panel 100 by using a chip on film (COF), may be a gate driver on array (GOA) and be directly formed on the display panel 100, or may be a chip on glass (COG).

In this solution, the scanning drive circuit 130 or the corresponding resistance compensation circuit 140 is not arranged at a particular location, may be flexibly arranged on the drive circuit board 120 according to needs in different manufacture procedure processes of the display panel 100 and be connected to the display panel 100, may be arranged in the gate driver chip 132 and be connected to the display panel 100 by using a chip on film (COF), may be a gate driver on array (GOA) and be directly formed on the display panel 100, or may be a chip on glass (COG), and may be applicable to a multiplicity of display panels 100.

In this embodiment, optionally, the scanning drive circuit 130 includes a multiplicity of gate driver chips 132, and the resistance compensation circuit 140 is arranged in at least one of the gate driver chips 132.

In this solution, the resistance compensation circuit 140 is arranged in at least one of the gate driver chips 132, so that a gate drive signal of a scanning line 110 output by the gate driver chip 132 provided with the resistance compensation circuit 140 reaches a target gate drive signal, and a difference between the gate drive signal of the scanning line 110 provided with the resistance compensation circuit 140 and the target gate drive signal is reduced, to improve a situation in which display effects of horizontal display areas of the display panel 100 are different, thereby improving a display effect of the display panel 100.

In this embodiment, optionally, the scanning drive circuit 130 includes a multiplicity of gate driver chips 132, the same resistance compensation circuit 140 is provided in all the gate driver chips 132, the scanning drive circuit 130 further includes a location signal cable 131, connected to the drive circuit board 120 and transmitting corresponding location information of the current scanning line 110 on the display panel 100, the corresponding location information of the scanning line 110 on the display panel 100 corresponds to a resistance compensation value recorded in the gate drive resistance compensation table 142, and the resistance value selection circuit 143 performs resistance compensation on the output end of the current scanning drive circuit 130 according to the resistance compensation value.

In this solution, the resistance compensation circuit 140 searches for the resistance compensation value, corresponding to the location information, in the memory 141 according to the corresponding location information of the current scanning line 110 on the display panel 100 transmitted by the location signal cable in the scanning drive circuit 130, to perform resistance compensation on the output end of the current scanning drive circuit 130 through the resistance value selection circuit 143 provided that in the method of looking up the gate drive resistance compensation table 142 by determining the location information of the scanning line 110, the compensated resistance value is more accurate, time of confirming the resistance value that needs to be compensated is saved, and working efficiency of the resistance compensation circuit 140 is more efficient while a situation in which display effects of horizontal display areas of the display panel 100 are different is improved, and a display effect of the display panel 100 is improved.

In this embodiment, optionally, the location signal cable 131 transmits a corresponding location value (ID) of the current scanning line 110 on the display panel 100.

In this solution, in a detection phase, after the gate drive resistance compensation table 142 is determined, each gate driver chip 132 feeds back, to a detector, a location value (ID) that can reflect the location of the current scanning line 110, and the gate driver chip 132 determines, according to the location value (ID), a voltage output through table lookup, and may directly determine the location information of the corresponding scanning line 110 by determining the location value (ID).

In this embodiment, optionally, the resistance value selection circuit 143 includes a selector switch 144 and a digital resistor 145, and the selector switch 144 selects to open a corresponding digital resistor according to the corresponding location value (ID) of the current scanning line 110 on the display panel 100, so that the corresponding scanning line 110 is connected in series to the digital resistor 145 having a corresponding resistance value for resistance compensation.

In this solution, the selector switch 144 may be flexibly turned on and turned off. After the selector switch 144 is turned on, the digital resistor 145 and the corresponding scanning line 110 are connected in series to implement resistance compensation. By using the digital resistor 145, a compensation resistance value read from the memory 141 may be directly presented as an actual resistance value of the digital resistor 145.

In this embodiment, optionally, the foregoing method is applied to resistance values of resistors connected in series, resistance values of resistors connected in parallel, and resistance values of resistors connected in series and in parallel provided that the high level voltage value of the output gate drive signal reaches a preset high level voltage value and has a function of changing potential of the output scanning line 110.

In this solution, the used method not only is applied to a case of resistance values of resistors connected in series but also has a function of changing the gate drive signal of the output scanning line 110 in cases of resistance values of resistors connected in parallel and resistance values of resistors connected in series and in parallel. The method may be applicable to a multiplicity of display panels 100.

The panel in this application may be a twisted nematic (TN) panel, an in-plane switching (IPS) panel, or a multi-domain vertical alignment (VA) panel, and may certainly be any other suitable type of panel.

The foregoing contents are detailed descriptions of this application in conjunction with specific preferred embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A detection method, comprising:

obtaining a gate drive signal of a scanning line in a current group of scanning lines from a plurality of groups of scanning lines;

externally connecting to a compensation resistor having an adjustable resistance value and adjusting the resistance value of the compensation resistor;

storing the resistance value of the current compensation resistor as a resistance compensation value of the current group of scanning lines when the gate drive signal after adjustment satisfies a preset target gate drive signal condition;

writing the location of the current group of scanning lines and the corresponding resistance compensation value into a gate drive resistance compensation table; and completing resistance compensation detection of all groups of scanning lines of a current display panel.

2. The detection method according to claim 1, wherein the step of obtaining a gate drive signal of a scanning line in a current group of scanning lines from a plurality of groups of scanning lines comprises:

detecting a high level voltage value of the obtained gate drive signal; and the step of storing the resistance value of the current compensation resistor as a resistance compensation value of the current group of scanning lines when the gate drive signal after adjustment satisfies a preset target gate drive signal condition comprises:

considering that the gate drive signal after adjustment satisfies the preset target gate drive signal condition when the high level voltage value of the gate drive signal after adjustment reaches a preset high level voltage threshold.

3. The detection method according to claim 2, wherein the preset high level voltage threshold is greater than or equal to a high level voltage value of a gate drive signal of a scanning line farthest from a drive circuit board of the display panel.

4. The detection method according to claim 1, wherein detection starts from a scanning line farthest from a drive circuit board of the display panel.

5. The detection method according to claim 2, wherein detection starts from a scanning line farthest from a drive circuit board of the display panel.

6. The detection method according to claim 3, wherein detection starts from the scanning line farthest from the drive circuit board of the display panel.

7. The detection method according to claim 1, wherein detection starts by using a gate drive signal of a scanning line farthest from a drive circuit board of the display panel as a target gate drive signal condition.

8. The detection method according to claim 2, wherein detection starts by using a gate drive signal of a scanning line farthest from a drive circuit board of the display panel as a target gate drive signal condition.

9. The detection method according to claim 3, wherein detection starts by using the gate drive signal of the scanning line farthest from the drive circuit board of the display panel as a target gate drive signal condition.

10. The detection method according to claim 9, wherein the display panel comprises a plurality of gate driver chips, and a plurality of close gate driver chips is used as a group.

11. The detection method according to claim 1, wherein the display panel comprises a plurality of gate driver chips, and the plurality of groups of scanning lines uses scanning lines output by a gate driver chip as a group.

12. A drive method, comprising:

looking up, according to the location of a current data line, a preset gate drive resistance compensation table adapted to a corresponding resistance compensation value to compensate an output signal;

wherein the gate drive resistance compensation table is obtained by:

obtaining a gate drive signal of a scanning line in a current group of scanning lines from a plurality of groups of scanning lines;

externally connecting to a compensation resistor having an adjustable resistance value and adjusting the resistance value of the compensation resistor;

storing the resistance value of the current compensation resistor as a resistance compensation value of the current group of scanning lines when the gate drive signal after adjustment satisfies a preset target gate drive signal condition;

writing the location of the current group of scanning lines and the corresponding resistance compensation value into the gate drive resistance compensation table; and completing resistance compensation detection of all groups of scanning lines of a current display panel.

13. A display panel, provided with a plurality of scanning lines and further comprising:

a drive circuit board, a scanning drive circuit, and a resistance compensation circuit, wherein the resistance compensation circuit is arranged between an output end of the scanning drive circuit and a corresponding scanning line; and the resistance compensation circuit comprises:

a memory, storing a gate drive resistance compensation table; and a resistance value selection circuit, reading a resistance compensation value corresponding to the location of the current scanning line from the memory and performing resistance compensation on the output end of the current scanning drive circuit according to the resistance compensation value;

wherein the gate drive resistance compensation table is obtained by:

obtaining a gate drive signal of a scanning line in a current group of scanning lines from a plurality of groups of scanning lines;

externally connecting to a compensation resistor having an adjustable resistance value and adjusting the resistance value of the compensation resistor;

storing the resistance value of the current compensation resistor as a resistance compensation value of the current group of scanning lines when the gate drive signal after adjustment satisfies a preset target gate drive signal condition;

writing the location of the current group of scanning lines and the corresponding resistance compensation value into the gate drive resistance compensation table; and completing resistance compensation detection of all groups of scanning lines of a current display panel.

14. The display panel according to claim 13, wherein the scanning drive circuit comprises a plurality of gate driver chips, and the resistance compensation circuit is arranged in at least one of the gate driver chips.

15. The display panel according to claim 13, wherein the scanning drive circuit comprises a plurality of gate driver chips, the same resistance compensation circuit is provided in all the gate driver chips, the scanning drive circuit further comprises a location signal cable, transmitting corresponding location information of the current scanning line on the display panel, the corresponding location information of the scanning line on the display panel corresponds to a resistance compensation value recorded in the gate drive resistance compensation table, and the resistance value selection circuit performs resistance compensation on the output end of the current scanning drive circuit according to the resistance compensation value.

16. The display panel according to claim 13, wherein the resistance value selection circuit comprises a selector switch and a digital resistor, and the selector switch selects to open a corresponding digital resistor according to a corresponding location value of the current scanning line on the display panel, so that the corresponding scanning line is connected in series to the digital resistor having a corresponding resistance value for resistance compensation.

17. The display panel according to claim 15, wherein the resistance value selection circuit comprises a selector switch and a digital resistor, and the selector switch selects to open a corresponding digital resistor according to a corresponding location value of the current scanning line on the display panel, so that the corresponding scanning line is connected in series to the digital resistor having a corresponding resistance value for resistance compensation.

18. The display panel according to claim 14, wherein the display panel comprises a plurality of gate driver chips, and a plurality of close gate driver chips is used as a group.

19. The display panel according to claim 14, wherein the display panel comprises a plurality of gate driver chips, and the plurality of groups of scanning lines uses scanning lines output by a gate driver chip as a group.

* * * * *